US005887298A

United States Patent [19]

Semidey

[11] Patent Number: 5,887,298

[45] Date of Patent: Mar. 30, 1999

[54] DECORATIVE BATH ENSEMBLE

[76] Inventor: Yanet A. Semidey, 11791 Valley Ridge Cir., Fairfax, Va. 22033

[21] Appl. No.: 15,916

[22] Filed: Jan. 30, 1998

[51] Int. Cl.[6] ..... A47K 17/00

[52] U.S. Cl. ..... 4/661; 4/242.1; D6/520

[58] Field of Search ..... 4/661, 901, 242.1; D6/520, 523; 242/598.4, 598.5; 206/233, 391, 581

[56] References Cited

U.S. PATENT DOCUMENTS

| | | | |
|---|---|---|---|
| D. 149,626 | 5/1948 | Fielding . | |
| D. 195,397 | 6/1963 | Whitehorn . | |
| D. 214,444 | 6/1969 | Weinman . | |
| D. 333,701 | 3/1993 | Meeks . | |
| D. 361,234 | 8/1995 | Ball | D6/520 |
| D. 370,724 | 6/1996 | Elsey . | |
| D. 388,989 | 1/1998 | Puckerin | D6/520 |
| 2,608,694 | 9/1952 | McCamy . | |
| 2,637,360 | 5/1953 | Doebler | 4/661 |
| 2,788,043 | 4/1957 | Dolnick . | |
| 2,910,705 | 11/1959 | Coplin . | |
| 3,085,611 | 4/1963 | Dolnick . | |
| 3,118,149 | 1/1964 | Tomasetti | 4/242.1 |
| 4,854,501 | 8/1989 | Ricci | 239/54 |
| 4,932,084 | 6/1990 | Hanson | 4/661 |
| 5,303,506 | 4/1994 | Weder . | |
| 5,426,793 | 6/1995 | Mac | 4/242.1 |
| 5,490,291 | 2/1996 | Direnzo . | |

FOREIGN PATENT DOCUMENTS

| | | |
|---|---|---|
| 2651663 | 9/1989 | France . |
| 2681232 | 9/1991 | France . |
| 488744 | 7/1938 | United Kingdom . |

*Primary Examiner*—Charles R. Eloshway
*Attorney, Agent, or Firm*—Richard C. Litman

[57] ABSTRACT

A coordinated decorative bath ensemble that is both beautiful and functional. The coordinated decorative bath ensemble comprises a decorative tissue paper storage receptacle, a waste container basket skirt, a clothes hamper skirt, a towel skirt, a cover for the toilet tank lid, a cover for the toilet bowl seat lid, a decorative scarf, and a decorative panel. Although the coordinated decorative bath ensemble contains numerous articles, the ensemble produces a single effect. The single effect is a beautiful, color and pattern coordinated bathroom. The decorative tissue paper storage receptacle makes new rolls of tissue paper readily accessible to the user.

6 Claims, 4 Drawing Sheets

DECORATIVE BATH ENSEMBLE

BACKGROUND OF THE INVENTION

1. Field of the Invention

The present invention relates to a decorative bath set that is used to decorate bathroom interiors and, more specifically, to a coordinated decorative bath ensemble for covering toilet seat lids and toilet tank covers, storing extra toilet paper rolls, skirting hanging towels and adorning shower curtains.

2. Description of the Related Art

Enhancing the physical appearance of a room in a home or any other place of abode is very important psychologically because a strong sense of well-being and satisfaction is obtained when a room has the proper decorum. The physical appearance of the rooms of any dwelling play a crucial role in the perceived and actual value of the property.

One of the most important rooms in any dwelling, especially a home, is the bathroom. Most residences have two or more bathrooms; therefore, the decorum of the bathrooms in a house can have a profound effect on the market value of the house. The decorum of the bathrooms in a house plays a key role in the comfort level of the house because the bathroom is one of the most frequently used rooms in a home. In fact, it has been estimated that a 65 year old person spends 3–5 percent or approximately 25,000 hours of his or her lifetime inside the bathroom.

The prior art describes a number of decorative articles that are used to improve the decorum of a bathroom. However, the prior art does not describes a coordinated ensemble of decorative articles that synergistically interact producing a single strikingly stunning effect that is both exquisitely beautiful and very functional.

U.S. Design Pat. No. 149,626 issued on May 18, 1948 to F. H. Fielding describes a decorative cushion seat for a toilet cover. The decorative article of the Fielding design patent involves a single item. U.S. Design Pat. No. 195,397 issued on Jun. 11, 1963 to P. T. Whitehorn describes a decorative toilet seat cover. The decorative article of the Whitehorn design patent only involves a single item. U.S. Design Pat. No. 214,444 issued on Jun. 17, 1969 to Mary Weinman describes a decorative cover for a toilet bowl. The Weinman design patent like the other two aforementioned design patents involves only a single item.

U.S. Design Pat. No. 370,724 issued on Jun. 11, 1996 to Susan G. Elsey describes a decorative toilet tank skirt. The Elsey design patent like the other cited design patents involves only a single item. U.S. Pat. No. 2,788,043 issued on Apr. 9, 1957 to Seymour S. Dolnick describes a cover for the toilet flush tank. The flush tank cover prevents condensation from forming on the flush tank as a result of moisture in the room air condensing on the cold, exposed wall surfaces of the flush tank and dripping onto the bathroom floor which creates a potentially injurious situation.

U.S. Pat. No. 2,608,694 issued on Sep. 2, 1952 to Robert Gardner describes a cover for a toilet seat lid that contains an elastic cord at the edge of the material of the cover that serves to hold the lid cover firmly in place. The elastic cord has a gap at the back of the cover where the lid is hinged so that the elastic cord will not interfere with the opening and closing of the lid. U.S. Pat. No. 2,910,705 issued on Nov. 3, 1959 to Eli B. Coplan also describes a cover for a toilet seat lid. The toilet seat lid cover has elastic sewn around its entire margin which allows the cover to fit snugly on the lid.

U.S. Pat. No. 3,085,611 issued on Apr. 16, 1963 to S. S. Dolnick describes a decorative and insulating toilet bowl cover that covers the marks and defects on the toilet bowl while at the same time insulating the bowl against both moisture and undesirable noise. U.S. Pat. No. 5,490,291 issued on Feb. 13, 1996 to Christine J. Direnzo describes lace works for a bathroom sink on a counter top of a vanity. The elongated ribbon of lace fabric serves as a decorative border about the rim of the bathroom sink on the counter top of the vanity.

None of the above inventions and patents, taken either singly or in combination, is seen to describe the instant invention as claimed. The prior art decorative articles address a particular problem but make no attempt whatsoever to transform an ordinary bathroom into an extraordinary bathroom with a splendid functional decorum.

SUMMARY OF THE INVENTION

Accordingly, it is a principal object of the invention to provide a coordinated decorative bath ensemble that produces a strikingly exquisite appearance.

It is another object of the invention to provide a coordinated decorative bath ensemble that is functional as well as beautiful, including a towel skirt to prevent slippage of a hanging towel, a closed bottomed towel skirt for storing a folded towel, and a toilet paper roll storage device.

It is a further object of the invention to provide the consumer with the convenience of a single kit that has all the necessary articles needed to transform an ordinary bathroom decorum into an extraordinary bathroom decorum.

It is an object of the invention to provide improved elements and arrangements thereof for the purposes described which is inexpensive, dependable and fully effective in accomplishing its intended purpose.

To meet the above objectives the present invention provides a coordinated collection of articles whose total effect is greater than the sum of the individual effects of the various articles. All designs and materials combinations are original. The way the fabrics are mixed, the combination of the decorative accessories, and the grouping of the various pieces together are original. The coordinated decorative bath ensemble of the present invention is a completely original decorative scheme. The articles of the ensemble are color and pattern coordinated.

The coordinated decorative bath ensemble is not only beautiful but very functional. The decorative tissue storage receptacle stores tissue in a convenient and readily accessible manner while the other articles are coordinated in such a manner that items routinely used in the bathroom are readily available to the user. The present invention not only beautifies a bathroom but the ensemble organizes a bathroom as well. The ensemble is an bathroom organizer that strategically organizes a bathroom, placing and storing the bathroom items that are used on either a daily or regular basis within easy reach of one another.

The present invention makes it possible for the consumer to completely decorate or redecorate his or her bathroom with a single purchase saving both time and money.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
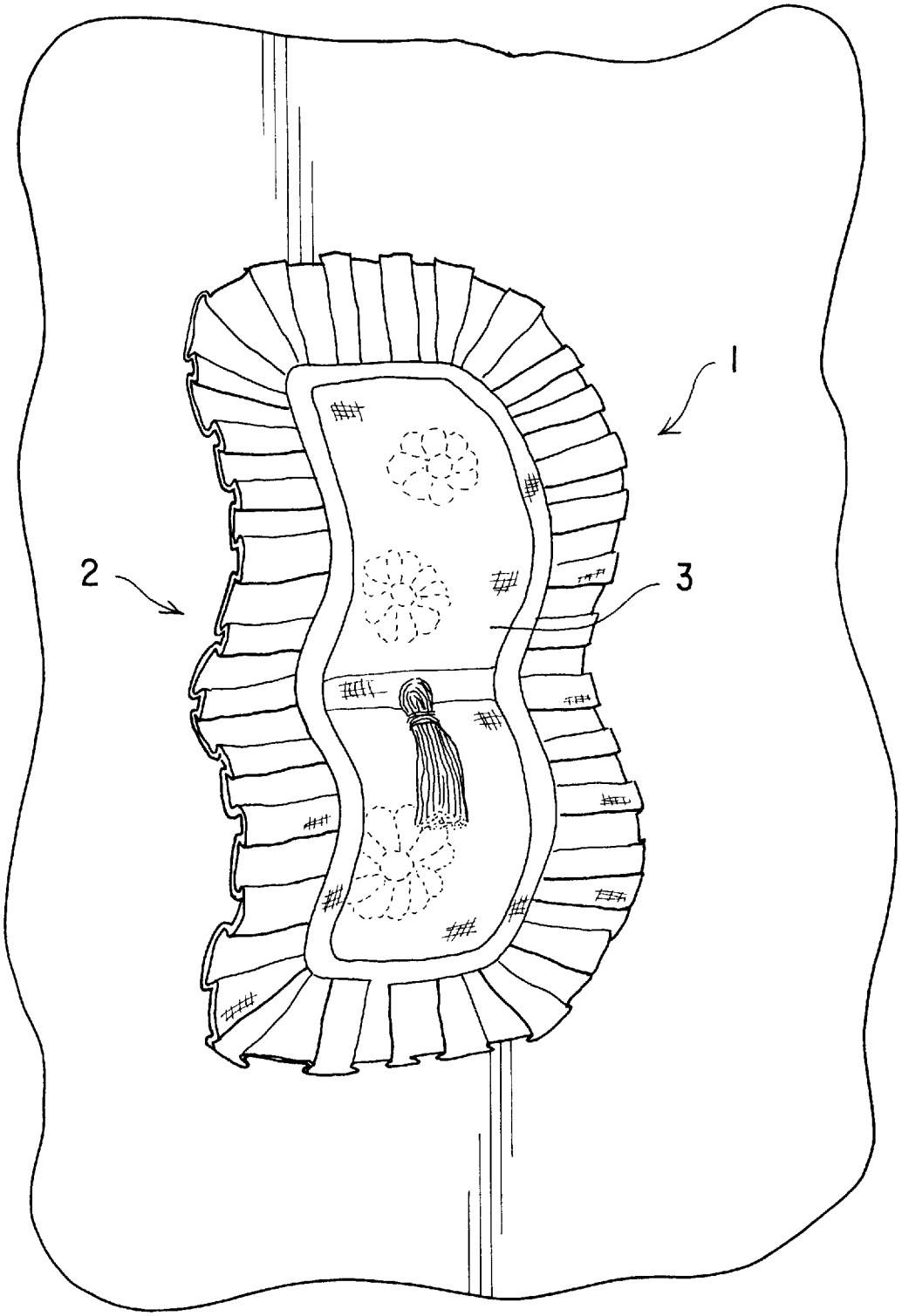
FIG. 1 is a front view of the present invention showing the decorative pattern on the front exterior of the tissue paper storage article.

FIG. 1 shows the front exterior 2 of the decorative tissue storage receptacle 1 in a preferred embodiment. The beautiful decorative pattern displayed in FIG. 1 is an illustration of one of the many decorative patterns of the present invention. The front exterior 2 of the tissue storage receptacle 1 comprises a front surface 3 and a rear surface 5 (hidden in FIG. 1).

Figure 3:
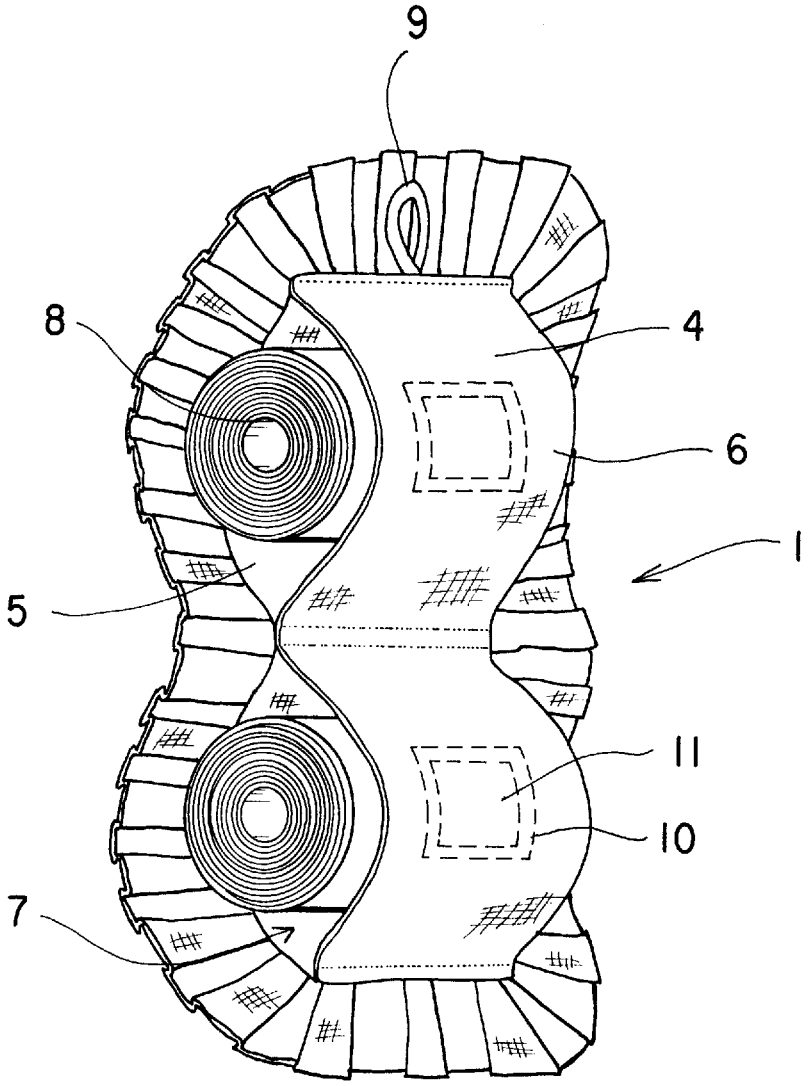
FIG. 3 is a rear view of the present invention of the tissue paper storage article of FIG. 1.

FIG. 3 shows the rear exterior 4 of the tissue storage receptacle 1. The rear exterior 4 is partitioned. The rear exterior 4 attaches to the rear surface 5 of the front exterior 2 at three locations. The rear exterior 4 attaches to the top portion, the middle portion, and the bottom portion of the rear surface 5 of the front exterior 2. The partitioning of the rear exterior 4 of the tissue storage receptacle 1 creates two pouches 6 that form the interior 7 of the tissue storage receptacle 1.

A roll of toilet tissue 8 is placed in each pouch 6 as shown in FIG. 3. The rear exterior 4 of the tissue storage receptacle 1 has a clothed hook 9 located near the top of the rear exterior 4 that is used to mount the receptacle 1 in a desired location. Any suitable securing means can be used to mount the receptacle 1, for example, a nail in the wall.

Each pouch 6 of the tissue storage receptacle 1 is provided with a pocket 10 that is used to hold a sachet (fragrance) bag 11. FIG. 3 shows a preferred embodiment wherein two pockets 10 are located on the rear exterior surface 4 of the receptacle 1. However, the location and the number of pockets 10 can be varied.

For example, the pockets 10 can be located on the rear interior wall of the pouches 6 or on the front interior wall of the pouches 6 or there can be a single pocket 10 located on either pouch 6. The location and the number of the pockets 10 are an obvious matter of design choice. The pockets 10 are also optional.

If more tissue storage space is required, multiple tissue storage receptacles may be provided. The multiple tissue storage receptacles are either lined up end to end to form an elongated decorative tissue storage receptacle or lined up side by side to form a broad decorative tissue storage receptacle. However, it is obvious that other storage receptacle arrangements can be contemplated and used. The actual arrangement of the multiple tissue storage receptacles is an obvious matter of design choice.

Figure 2:
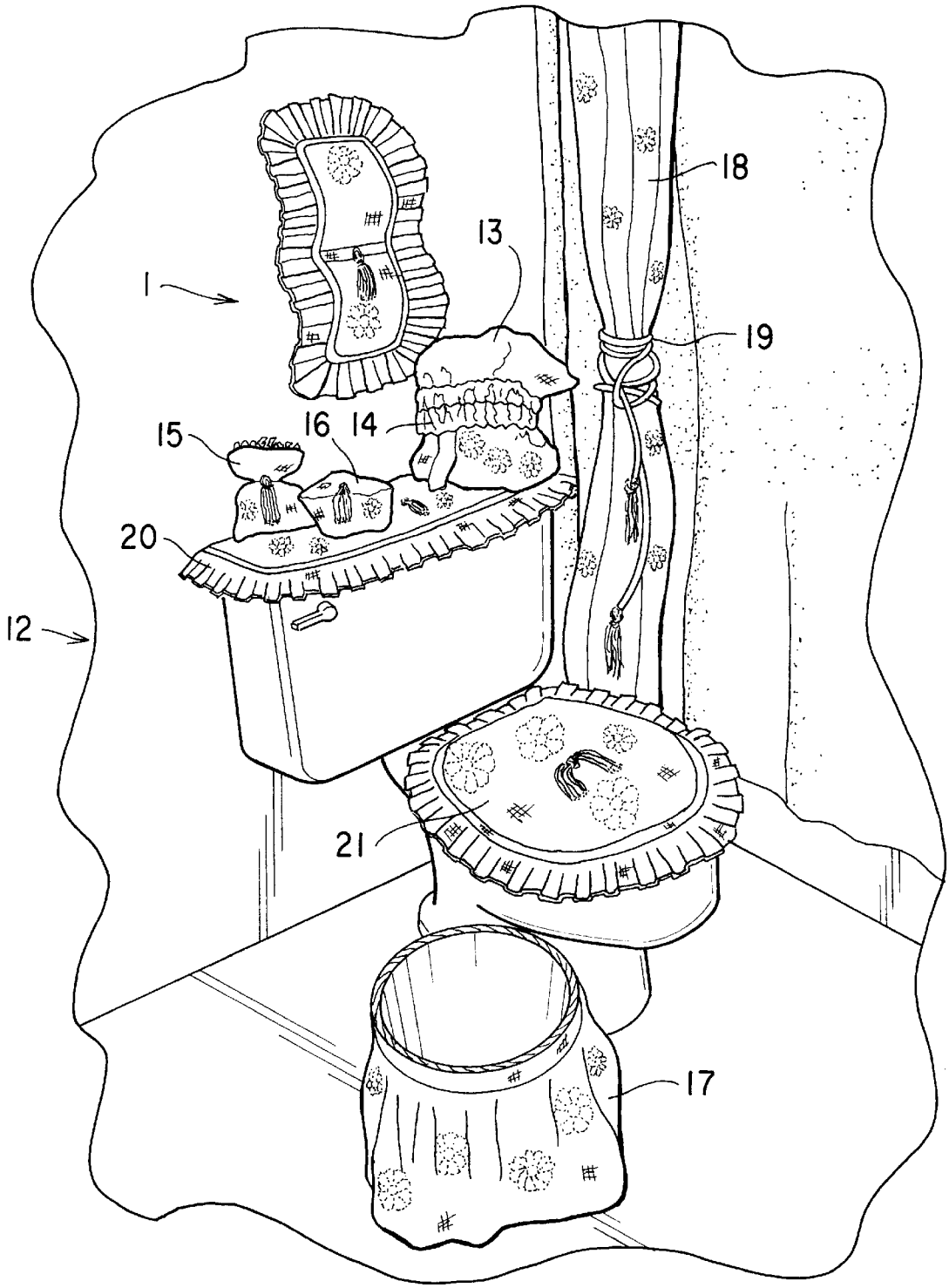
FIG. 2 is an environmental, perspective view of the present invention showing each of the component parts of the coordinated decorative bath ensemble.

FIG. 2 shows a preferred embodiment of a coordinated decorative bath ensemble 12 that clearly demonstrates that the present invention not only enhances the physical appearance of a bathroom but organizes the bathroom as well. It is clear from FIG. 2 that the present invention is a bathroom with the respective articles of the ensemble 12 strategically arranged to facilitate the activities routinely carried out in a bathroom.

For example, the towel 13 in the closed bottom towel skirt 14 is within easy reach of someone taking a shower, whereas the tissue storage receptacle 1 is located within easy reach of someone whose has run out of toilet tissue while using the toilet.

FIG. 2 shows how the various articles of the ensemble 12 interact synergistically with one another to produce a stunningly elegant, yet functional, decorum. The articles of the ensemble are color and pattern coordinated. The ensemble articles depicted in FIG. 2 are a tissue storage receptacle 1, a potpourri bag 15, a sachet bag holder 16, a closed bottom towel skirt 14, a waste basket skirt 17, a panel 18 with decorative cord 19, a cover for the toilet tank lid 20, and a cover for the toilet bowl seat lid 21.

The cover 21 for the toilet bowl seat lid is an oval shaped fabric cover made with fabric, padding, and liner. The seat lid cover 21 is decorated with trim and tassels. The seat lid cover 21 is secured to the seat lid by two elongated elastic bands (not shown) that transverse the bottom surface of the seat lid. The cover 20 for the toilet tank lid is a rectangular fabric cover 20 that follows the contour of the toilet tank lid. The tank lid cover 20 is made of any suitable fabric, padding, and a liner.

The toilet tissue (paper) storage receptacle 1 (holder) comprises a large piece of fabric in the front 2 that is decorated with fabric, trim and/or tassels. The large piece of fabric in front 2 is stuffed with padding and has a liner. The waste basket skirt 17 is used to cover the waste basket. The basket skirt 17 is secured to the waste basket using either elastic bands or hangers (not shown). A clothes hamper skirt (not shown) is also part of the decorative bath ensemble 12. The hamper skirt is used to cover a clothes hamper in a similar manner as shown by the waste basket skirt 17. The hamper skirt is made with fabric and trims.

The panels 18 are used to decorate selected areas of a bathroom. For example, panels 18 are used to decorate a shower curtain or a shower door. The panels 18 hang vertically from the top surface of a shower curtain or a shower door. The panel 18 is made with fabric, tassels, and trims. The panel 18 has a decorative cord 19 tied around it as depicted in FIG. 2. A decorative band (not shown) can be substituted for the decorative cord 19. Both the decorative band and the decorative cord 19 are optional. The decorative bath ensemble 12 also includes a decorative scarf (not shown) that hangs horizontally across the top surface of a shower curtain or shower door. The scarf is also made with fabric, tassels, and trims.

The decorative bath ensemble 12 also has a holder for bath salts (not shown). The bath salts bag (not shown) maintains the freshness of the bath salts. The decorative bath salts bag usually resides on top of the tank lid but can be placed in any readily accessible location inside the bathroom.

Figure 4:
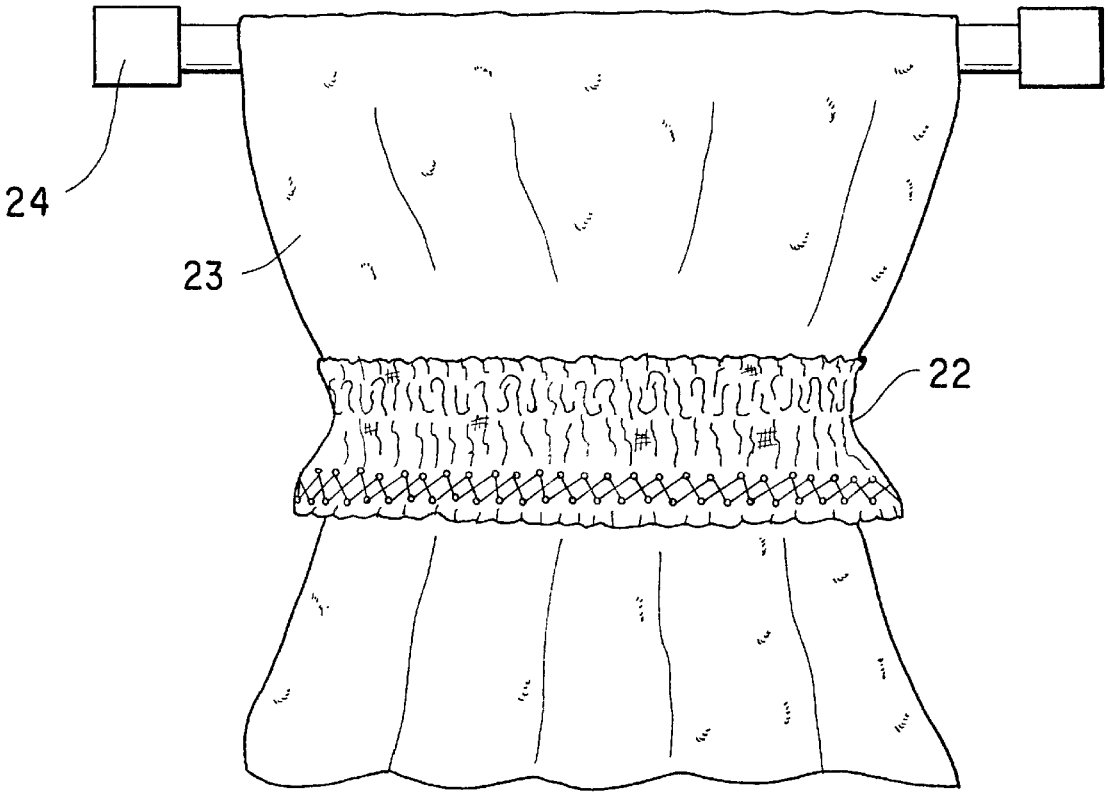
FIG. 4 is a environmental, front view of the present invention showing a towel wearing a towel skirt.

FIG. 4 shows an alternate embodiment of the towel skirt 22. The open bottom towel skirt 22 depicted in FIG. 4 is used to decorate a towel 23 hanging from a towel rack 24 and assists in preventing it from slipping from a towel bar when hung by frictionally binding the draped lower halves of the towel together. The towel skirt 22 is decorated with fabric, trim and/or tassels and the towel skirt 22 has an elastic waist band. The closed bottom towel skirt 14 depicted in FIG. 2 is located on top of the tank lid cover 20 and also has an elastic waist band pinching the folded towel.

The aforementioned articles are the primary articles of the decorative bath ensemble; however, other accessory articles can be added to the ensemble as needed. The ensemble articles can be made from a broad spectrum of suitable fabrics and can have a multitude of designs and patterns. The selection of a specific fabric, a specific pattern, and a specific design is an obvious matter of design choice and within the scope of the present invention as claimed.

The preferred embodiments of the present invention disclosed herein are intended to be illustrative only and are not intended to limit the scope of the invention. It should be understood by those skilled in the art that various modifications and adaptations as well as alternative embodiments may be contemplated. It is to be understood that the present invention is not limited to the embodiments described above, but encompasses any and all embodiments within the scope of the following claims.

I claim:

1. A tissue paper storage article to store rolls of tissue paper comprising:

a hanging means for securing the tissue paper storage article to a surface;

a front exterior having a front surface and a rear surface;

a partitioned rear exterior having a front surface and a rear surface;

said partitioned rear exterior attached to said rear surface of said front exterior in multiple locations;

said partitioned rear exterior attached to the top portion, the middle portion, and the bottom portion of said rear surface of said front exterior;

said partitioning of said rear exterior creating two pouches that form the interior of said tissue paper storage article;

a storage pocket on said rear surface of said rear exterior for each of said pouches; a fragrance bag disposed in each said pocket; and wherein said tissue paper storage article is made of a suitable fabric.

2. A tissue paper storage article according to claim 1 wherein:

said hanging means is a hook;

said front exterior is decorated.

3. A coordinated decorative bathroom ensemble that includes the tissue paper storage article of claim 1 comprising:

a decorative cover for a toilet bowl seat lid;

a decorative cover for a toilet tank lid;

a decorative waste basket skirt;

a decorative towel skirt;

a decorative potpourri bag;

a decorative sachet bag holder; and a decorative panel.

4. A coordinated decorative bathroom ensemble according to claim 3 wherein:

said decorative tissue paper storage article has a large piece of fabric decorated with trim and tassels;

said decorative cover for a toilet bowl seat lid is an oval shaped fabric cover that is decorated with trim and tassels;

said decorative cover for a toilet bowl seat lid is made with fabric, padding, and a liner;

said decorative cover for a toilet tank lid is a rectangular fabric cover that follows the contour of said tank lid;

said decorative cover for a toilet tank lid is made with fabric, padding, and a liner;

said decorative waste basket skirt securable to said basket by elastic bands;

said decorative towel skirt is made with fabric and decorated with trim;

said decorative towel skirt has an elastic waist band;

said decorative towel skirt has either an open or closed bottom;

said decorative panel is made with fabric and decorated with trim; and said decorative panel has either a decorative cord or a decorative band.

5. A coordinated decorative bathroom ensemble according to claim 4 wherein:

said coordinated decorative bathroom ensemble is color and pattern coordinated.

6. A coordinated decorative bathroom ensemble according to claim 3 wherein:

said coordinated decorative bathroom ensemble is color and pattern coordinated.

* * * * *